United States Patent [19]

Simpson

[11] Patent Number: 4,497,578

[45] Date of Patent: Feb. 5, 1985

[54] MACHINE FOR MIXING AND INJECTING WATER AND GROUT INTO A ROOF BOLT HOLE

[75] Inventor: Robert E. Simpson, Spokane, Wash.

[73] Assignee: The United States of America as represented by the Secretary of the Interior, Washington, D.C.

[21] Appl. No.: 168,815

[22] Filed: Jul. 10, 1980

[51] Int. Cl.[3] ..... B01F 5/04

[52] U.S. Cl. ..... 366/42; 366/51; 366/64; 366/169; 366/190; 366/333

[58] Field of Search ..... 222/137; 366/34, 36, 366/42, 51, 52, 64, 65, 154, 167, 168, 169, 189, 190, 289, 232, 233, 150

[56] References Cited

U.S. PATENT DOCUMENTS

| | | | |
|---|---|---|---|
| 2,633,340 | 3/1953 | Zagray | 366/51 |
| 3,188,057 | 6/1965 | Trumbull | 366/289 |
| 3,214,148 | 10/1965 | Thomas | 366/332 |
| 3,227,426 | 1/1966 | Williams | 366/51 |
| 3,231,245 | 1/1966 | Harvey | 366/51 |
| 3,793,886 | 2/1974 | Rosenwald | 366/189 X |

*Primary Examiner*—Billy J. Wilhite

*Attorney, Agent, or Firm*—Thomas Zack; Donald A. Gardiner

[57] ABSTRACT

An apparatus in which grout is extruded from the same chamber in which mixed. Provision is made to clean the system after it has undergone one cycle of mixing and extrusion. The basic components of the apparatus include a mixing chamber with a mixing ram having collapsible mixing fingers. Encircling this mixing ram is an extruding ram with a ram head. The mixing ram is concentric with and extends through a lower extruding ram cylinder with the upper portion of the mixing ram having a mixing head normally seated in the mixing chamber and concentric with the ram head. Provision is made to bring water into the mixing chamber, to insert grout in the same chamber, and to outlet the water and grout from the same.

8 Claims, 3 Drawing Figures

31
29
33
GROUT EXTRUDED HERE
3
1
CYL.# 3
21
VALVE #8
AIR MOTOR
CYL. #1
CYL. #4
CYL. #5
CYL. #2
VALVE #1
VALVE #2
VALVE #3
VALVE #4
VALVE #5
VALVE #6
VALVE #7
AIR INLET
MAIN WATER

MACHINE FOR MIXING AND INJECTING WATER AND GROUT INTO A ROOF BOLT HOLE

BACKGROUND OF THE INVENTION

1. Field of the Invention

The invention disclosed herein is an apparatus for mixing and injecting a grout material.

2. Description of the Prior Art

The prior art is replete with various types of mixing and dispensing devices. Many of the references disclose collaspsible agitators per se—for example, U.S. Pat. No. 3,214,148 to J. C. Thomas—and the U.S. Pat. No. 3,793,886 (G. W. Rosewald) discloses this same feature with the additional function to allow complete chamber evacuation. In the U.S. Pat. No. 3,188,057 (D. E. Trumbull), a single batch of fast setting compounds are mixed and dispensed. What applicant has not found in the prior art is the combination of an extrusion ram with a concentrically nested mixing rod having a fluid channel and collapsible agitator blades. It is this operative combination of features which allows the invention to accomplish its intended purpose.

SUMMARY OF THE INVENTION

The mixing and extrusion apparatus forming the subject matter of this invention has a mixing chamber that can be evacuated by an extrusion ram. Concentrically nested in the ram is a mixing rod which has a fluid channel and collaspible fingers or agitator blades. The mixing rod is provided with a drive shaft to rotate it. There is also provision made to raise and lower the mixing rod away from the ram within the mixing chamber. As the mixing rod rotates the normally collasped mixing fingers or blades are extended to mix the combined fluid being injected thereto and the previously loaded grout material. After the mixing is completed, the extrusion ram is actuated to move through the mixing chamber and force the compound out an orifice from where it is dispersed.

The primary object of this invention is an improved grout mixing and extrusion apparatus.

Figure 1:
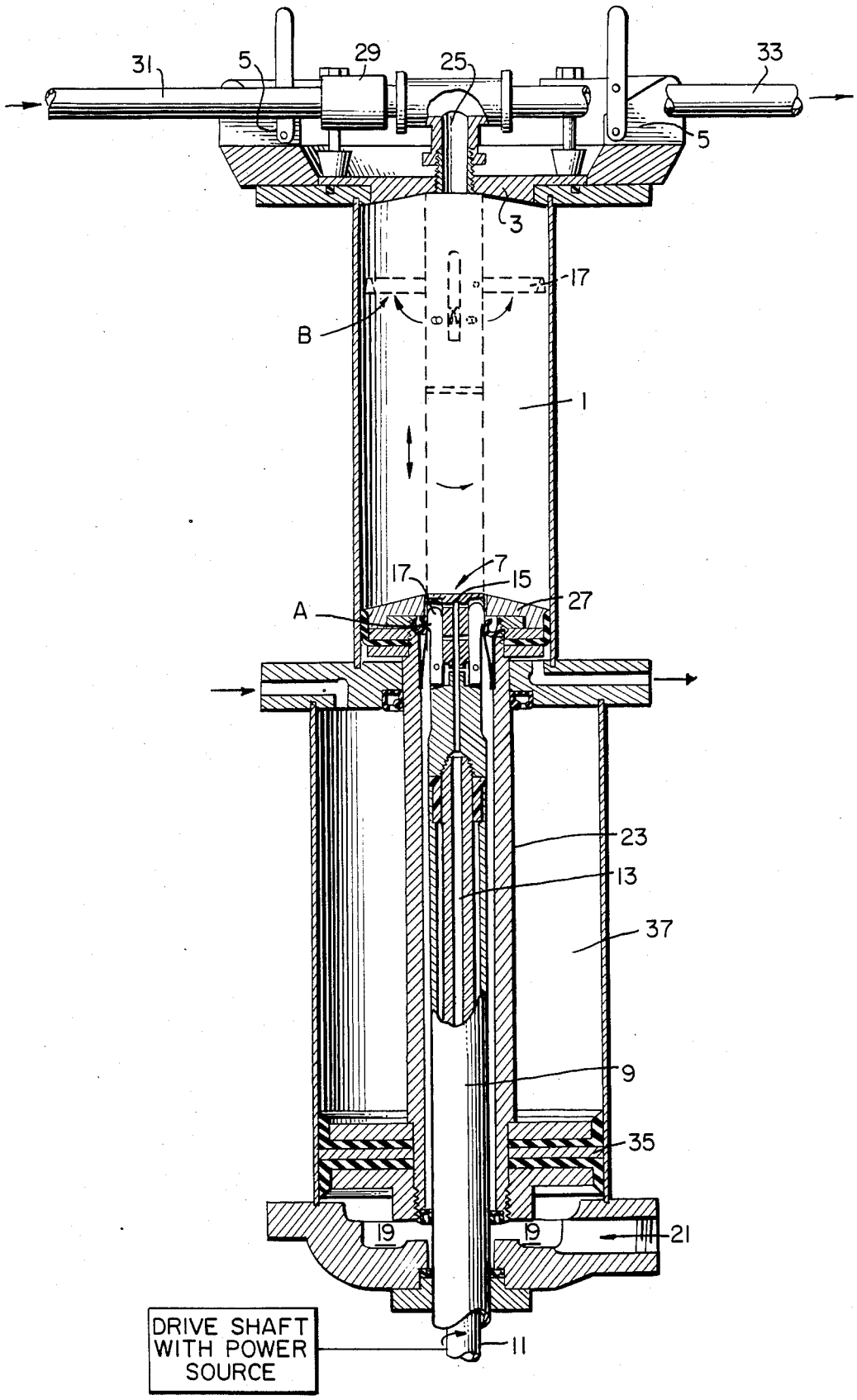
FIG. 1 is a cross-sectional view of the preferred embodiment of the invention.

The basic operation of the preferred embodiment can be described by referring to FIG. 1. Intially the dry material, like grout, which is to be mixed with a liquid is placed in the mixing cylinder 1. The cylinder's top cover plate 3 is then replaced and securely clamped down by the pair of quick release clamps 5. The mixing head 7—shown in its normal inoperative retracted positions A—is then raised in the chamber along with the mixing ram 9. As the power driven shaft 11 is turned, water is injected through the center opening 13 of mixing ram to exit from water exit holes 15. These exit holes are located behind the mixing fingers 17 or agitators. When the mixing head is not rotating, the mixing fingers are normally in a collapsed or retracted position nested in the top of the ram head. For ease in understanding, the same mixing head and fingers are shown (FIG. 1) in both the retracted (A) and extended position (B). The mixing head is pushed upwardly in the mixing chamber as it rotates. Due to the centrifugal forces acting on the fingers and their shape, the fingers open up (position B) to begin mixing the grout and water. To thoroughly mix the materials, the mixing head is lowered and raised as stirring takes place. After being completely mixed, the composition is ready for extruding. To do this the mixing head is held stationary in its top position B. Next, the cavity 19 is pressurized with air via opening 21. This causes the extruding ram 23 to move up forcing the grout in the mixing chamber out the upper orifice opening 25. The ram head 27 encircles the mixing ram and under the influence of pressurized air moves with the extruding ram until the extended mixing fingers are contacted. At that point the fingers are pushed to a retracted position inside of the ram head and the head 27 continues its stroke to the top of the mixing chamber. The normally closed valve 29 prevents the extruded grout from entering the upper water flush inlet 31 and allows it to exit from the outlet hose 33. Grout remaining in the outlet hose 33 is pushed out by pre-measured water from the water flush inlet. Some of the water flush enters the mixing chamber as the check valve 29 is opened. To allow a sufficient amount to enter the chamber the extruding ram is retracted to lower position A while the mixing head spins and is moved up and down. With the fingers extended and the movement indicated the remaining grout residual is flushed from the mixing cylinder via orifice 25 and outlet hose 33. This completes the general cycle and the apparatus of FIG. 1 is again ready for the introduction of a pre-measured amount of material into its mixing chamber.

This invention was designed to mix and inject very fast setting hydraulic cement or grout into mine roof bolt holes prior to the insertion of the roof bolt. Thus, it must be capable of mixing and extruding a viscous grout upward into a small-diameter hole within one-half minute. If the material hardens too fast while in the borehole the roof bolt cannot be inserted. If it takes too long (a few seconds) to set then the roof bolt needs additional support from the bolting machine since the grout itself cannot provide the support.

To achieve the rapid hardening of the grout material, chemical accelerators have been used. More importantly the smallest quantity of mixing water has been used because this is the most impotant contributor to the rapid hardening necessary for practical roof bolt grouting. This means the resulting grout will have a high viscosity which in turn limits usual pumping methods. With regular commercial pumping equipment the fluid to be pumped is fed by gravity aided by suction generated by the pump. In this case the fluid is of high viscosity and will not flow to the pump intake rapidly enough to provide a continuous flow without entrapment of air in large quantities. Also, ordinary pumps have a churning or squeezing action which often causes a premature or "flash" setting of the cement within the pump. (Note: Flash set is a term commonly used in the industry.) This invention corrects all of these possible drawbacks by mechanically extruding the grout from the same chamber in which it is mixed. It also mixes and extrudes an amount of grout plus 5 to 10 percent excess for one bolt at a time, and further, the system uses the grout remaining in the extrusion hose after the main piston has completed its full stroke by extruding a measured volume of water equivalent to the volume of the grout remaining in the hose. Extrusion of the measured amount of water equal to the grout in the hose serves to permit use of all of the grout efficiently and further, to flush the system.

Figure 2:
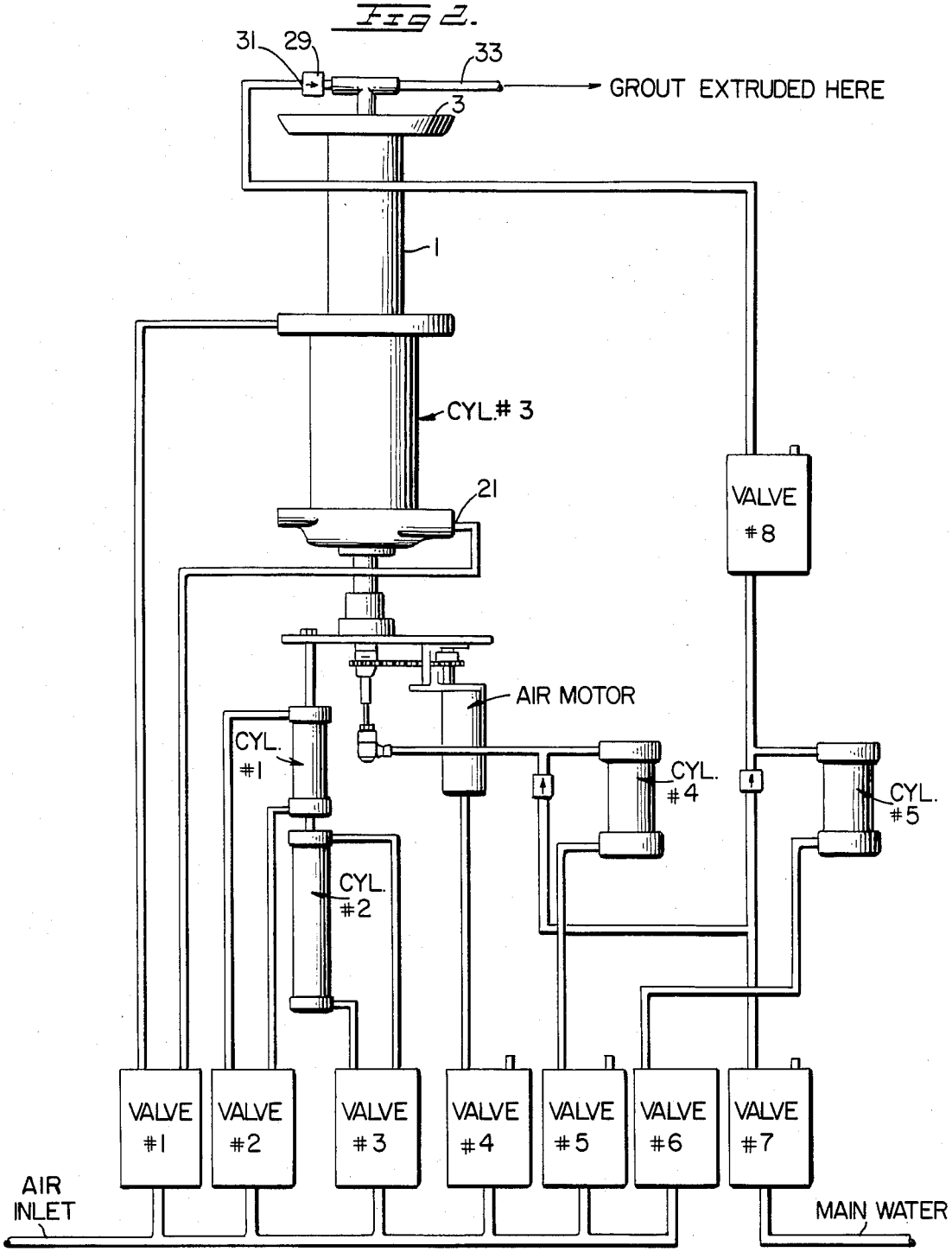
FIG. 2 is a schematic diagram for the air and water logic mechanism used to actuate the FIG. 1 components.

FIG. 2 is a schematic diagram of the system, and the mixing and extruding apparatus, used with the FIG. 1 preferred embodiment. The system employs eight valves (numbered 1 to 8), five cylinders (numbered 1 to 5), connecting conduits, and an air motor to move the air and water in the desired amounts and sequence. As previously stated, the mixing cylinder serves as the container for mixing of the cement and water grout by the mixing head, and further as the cylinder for the ram head which extrudes the mixed grout through the extruding outlet hose into the bolt hole. The ram head is forced upward by the compressed air powered extruding cylinder ram. At the completion of the full stroke of the extruding ram and while remaining under pressure against the top cover plate a portion of the grout required for filling the hole remains in the extruding hose. A volume of water exactly equivalent to that of the grout remaining in the hose is then injected by a metering cylinder into the hose at a grout extruding cylinder outlet and forces the grout from the hose to complete filling of the hole. This action also flushes the system. Further flushing is usually done by repeating a machine cycle water only. A complete cycle is normally accomplished in one-half minute.

Figure 3:
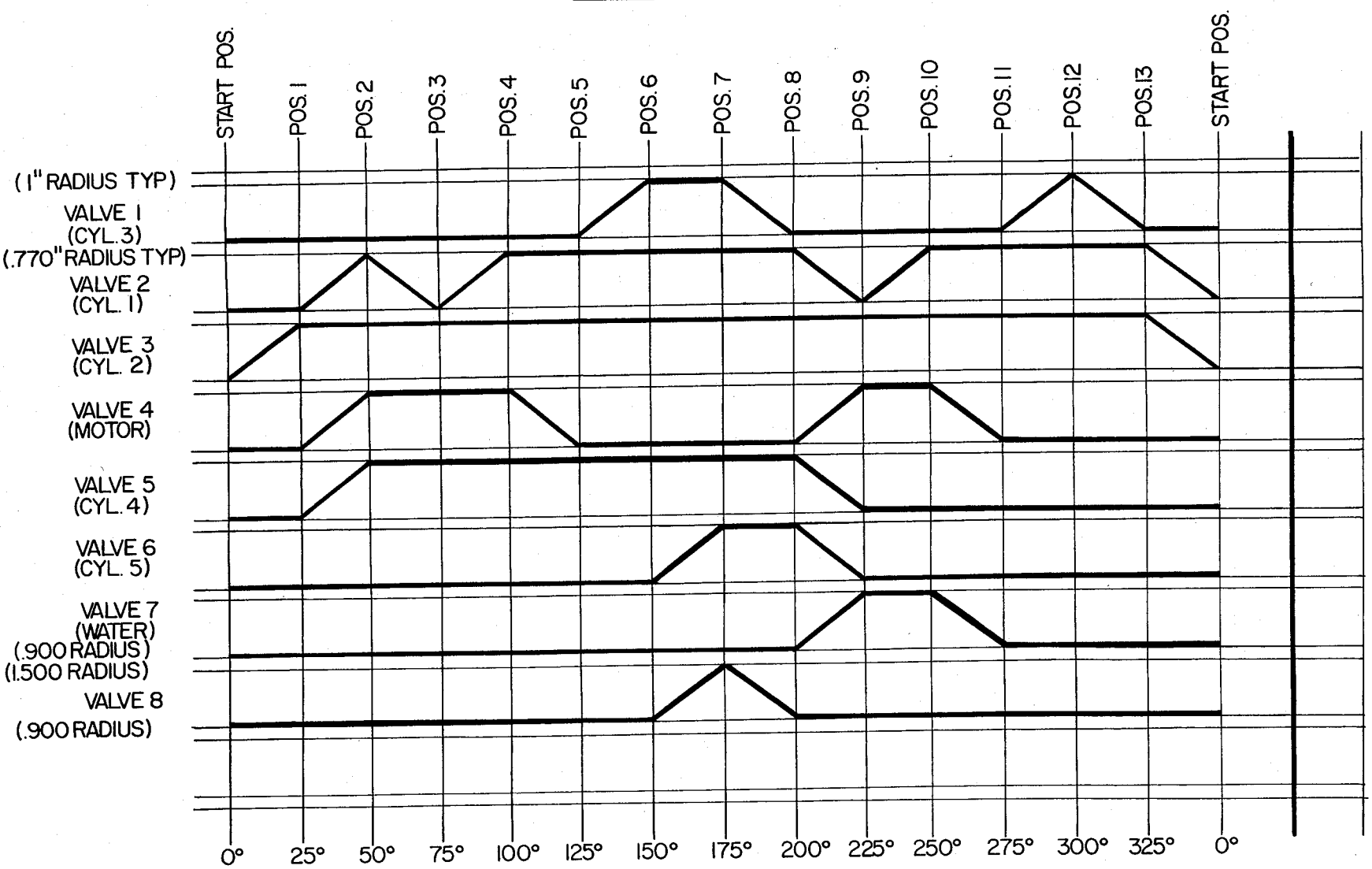
FIG. 3 is a timing diagram disclosing how the different valves of FIG. 2 are sequentially actuated to perform the cycle of operation.

FIG. 3 is a timing diagram to illustrate the sequence of actuation of the eight valves and how they relate to the thirteen positions. In the preferred embodiment all of the valves are cam controlled by manually turning a position handle. At the left hand starting position (POS.) all valves are closed and the premeasured grout is inserted through the top of the mixer and then the cover is securely locked in place. In POS. 1, the mixing head is raised in the mixing chamber from its lower seating position to its mixing position by actuating air driven valve 3. Next, a premeasured amount of water is injected into the mixing cylinder (POS. 2) by valve 5 as the air motor is started to turn the mixing head by valve 4 and the mixing ram is moved upward to the top of the mixing cylinder by valve 2. At POS. 3 of this diagram, the mixing ram is lowered to the bottom of the mixing cylinder by valve 2 as the mixing head turns. With the turning of the mixing head continuing, valve 2 is used to raise the mixing ram to the top of the mixing cylinder (POS. 4). Continuing, the machine at POS. 5 has its mixing head stopped turning by actuating valve 4. At POS 6 the extruding ram moves upward under the action of valve 1 to thereby extrude the grout through the outlet hose 33. POS. 7 finds three separate actions taking place. First, valve 8 is opening as a grouting valve. Second, the extruding ram is at its uppermost position under the action of valve 1. And lastly, premeasured water is forced through valves 8 and through hose 33 to thereby flush clean the hose and its attached discharge conduits, dispensers, etc. POS. 8 has valve 8 closed and the extruding ram lowered by valve 1. Next, valve 7 is turned on to run water through the system (POS. 9). When this happens the pre-measured supplies are filled with water (valves 5 and 6); the mixing head turns to allow it to be rinsed by valve 4; and the mixing ram is lowered by valve 2. The next position, POS. 10, has the mixing ram raised by valve 2 after the rinsing cycle is completed as the mixing cylinder is filled with water. Valve 4 stops the mixing head and the water is turned off at valve 7 (POS. 11). Then the extruding ram is moved upward forcing the rinse water out of the extruding hose from the air through valve 1 (POS. 12). The last position, POS. 13, is to lower the extruding ram by turning off valve 1. Lastly, all cylinders are returned to start by retracting the mixing fingers and lowering the mixing head in a ready state by closing valves 2 and 3. At this point the cover can be removed to begin the cycle. Many of the details of the FIG. 1 mixing and extruding apparatus have not been described but should be apparent from the operational description. For example, the mixing ram has a concentric water conduit and moves with that conduit and the mixing fingers in unison. The ram head normally seats in the bottom of the mixing cylinder and moves in unison with the cylinder extruding ram and its lower annular piston assembly 35, which assembly extends outwardly from the ram to the inner wall of the extruding cylinder 37. The pressurized air in cavity 19 is what moves the piston assembly, ram, and ram head upwardly and for downwardly. The mixing fingers are pivotally attached to the mixing head body so that they may move from an extended to a collapsed position with respect thereto. These fingers (four shown) are elongated members which are V-shaped in cross-section with the opened side of the V pointing downwardly. In their normally collapsed position the fingers are nested into the body of the mixing head so that they and the mixing head may fit into the encircling ram head when the mixing head is lowered. Also shown are appropriate gaskets, outlets, valves, connector etc. to allow the system to operate as heretofore described. These features should be apparent to a person of ordinary skill in the art and further description thereof is believed unnecessary.

This invention has been shown and described with respect to the introduction and mixing of grout for underground mine boreholes. It should not be limited to such a use or environment and would find utility in any situation where fast setting components are to be mixed and then extruded from the mixing chamber. None of the disclosed limitations should be used to limit the scope and extent of this invention which is to be measured only the claims that follow.

I claim:

1. An apparatus for mixing two components and then extruding the resultant mixture from the same chamber comprising:

a mixing chamber with a first opening to allow the introduction of one of the components to be mixed, said chamber having means to close the first opening and a second outlet opening to discharge the components after mixing;

a rotatable mixing head having retractable mixing fingers mounted thereon extending into said mixing chamber, said mixing head being mounted on a mixing ram and movable upwardly and downwardly in the chamber;

means for supplying a second component to said mixing chamber, said component being deposited in the chamber near the mixing fingers;

a movable extrusion ram having a ram head at its upper portion, said ram head being mounted in the mixing chamber and normally extending around the mixing head and its retracted fingers when the mixing head in its lower chamber position;

first means for rotating and moving the mixing head and its ram to mix said two components in the mixing chamber; and second means for independently moving the extrusion ram and its ram head from the movement of the mixing ram and head to provide for the extrusion of the two mixed components from the mixing chamber out of its second outlet opening.

2. The apparatus of claim 1 wherein:

said means to close the first opening is a door having quick release clamps; and said means for supplying a second component is a conduit extending through the mixing head which is connected to a source of pressurized fluid.

3. The apparatus of claim 1 wherein:

the mixing head and ram head have concentric centers with the mixing chamber.

4. The apparatus of claim 1 wherein:

said first means to move the mixing head and its ram is a drive shaft having a power source; and said separate means for moving the extrusion ram and its ram head is a movable piston within a cylinder driven by fluid pressure.

5. The apparatus of claim 1 also including in combination a source of fluid flush connected to said mixing chamber to help clean the chamber and its second opening of any remaining mixture.

6. The apparatus of claim 5 also including a conduit connected to said second opening to convey the mixture to its desired location, said conduit being cleanable by the fluid flush.

7. The apparatus of claim 1 wherein the mixing fingers are mounted on the mixing head by a pivot connection and are retractable to a nested position against the mixing head when the mixing head is seated in the lower chamber and the ram head encircles it.

8. The apparatus of claim 1 wherein the mixing fingers are elongated members that are V shaped in transverse cross-section.

* * * * *